United States Patent [19]

Rockwell

[11] Patent Number: 4,861,025

[45] Date of Patent: Aug. 29, 1989

[54] ARTICULATED STORABLE EXERCISE BENCH

[75] Inventor: Gary Rockwell, Auburn, Ala.

[73] Assignee: Diversified Products Corporation, Opelilka, Ala.

[21] Appl. No.: 139,662

[22] Filed: Dec. 30, 1987

[51] Int. Cl.[4] ..... A63B 21/00

[52] U.S. Cl. ..... 272/144; 272/117; 272/123; 108/112

[58] Field of Search ..... 272/117, 123, 134, 144, 272/DIG. 4; 108/112, 113

[56] References Cited

U.S. PATENT DOCUMENTS

| | | | |
|---|---|---|---|
| 4,407,495 | 10/1983 | Wilson | 272/117 |
| 4,564,194 | 1/1986 | Dawson | 272/117 X |
| 4,575,077 | 3/1986 | Osborne et al. | 272/123 X |
| 4,624,457 | 11/1986 | Sieberman et al. | 272/134 X |
| 4,729,561 | 3/1988 | Desjardins | 272/117 |

FOREIGN PATENT DOCUMENTS

| | | | |
|---|---|---|---|
| 0167367 | 1/1986 | European Pat. Off. | 272/144 |
| 2036021 | 1/1972 | Fed. Rep. of Germany | 108/113 |

*Primary Examiner*—Richard J. Apley
*Assistant Examiner*—Robert W. Bahr
*Attorney, Agent, or Firm*—Banner, Birch, McKie & Beckett

[57] ABSTRACT

An adjustable, floor-supported exercise bench has an articulated frame which can be locked in a horizontal position or inclined with the center portion of the frame depressed to provide proper support for a user and a fixed "reach" relative to an exercise member, regardless of the inclinations of the bench cushions.

20 Claims, 4 Drawing Sheets

ARTICULATED STORABLE EXERCISE BENCH

BACKGROUND OF THE INVENTION

This invention relates to exercise equipment and, in particular, to an exercise bench typically used in performing weightlifting or other resistance-type exercises.

In its simplest form a typical weightlifting bench of the prior art comprises a fixed horizontal seat cushion disposed between a pair of upright barbell supports, specifically adapted for performing classic prone bench pressing exercises. With the trend toward multifunctionality of exercise equipment, variations of the basic weightlifting bench have appeared in the prior art. For example, many prior art benches include split cushions wherein one or both of the seat cushions are inclinable with respect to the basic horizontal frame of the bench in order to increase the range of exercises that can be performed. Some include a variable height support at one end of the bench so that the entire bench frame can be inclined relative to the horizontal. Examples of multipurpose exercise benches can be found in Gaul U.S. Pat. No. 3,342,485 and Faust U.S. Pat. No. 4,098,502.

One drawback of these types of benches is that when the seat cushions are rearranged in an inclined fashion in order to perform an inclined bench press, the barbell rest cradles that formerly were at a proper height for performing the standard prone bench press no longer are properly located with respect to the user's shoulders and arms. In Metler U.S. Pat. No. 4,396,191 the barbell cradles automatically move vertically with the inclinable seat cushion of the bench in order to minimize the misalignment of shoulders and cradles. Accordingly, in Metler's and others' adjustable benches, additional structure must be provided in order to support the barbell in a higher rest position for an inclined bench press, making the bench and barbell assembly potentially less stable due to a raised center of gravity. Further, multipurpose bench designs of the prior art usually represent a compromise in seat cushion height and position for many of the exercises to be performed, including inclined bench presses, thus comprising comfort, ergonomics and safety for the sake of versatility. In addition, most exercise benches of the prior art occupy a large amount of space, there being no provision for rendering them more compact when not in use.

SUMMARY OF THE INVENTION

It is, therefore, an object of the present invention to provide a weightlifting-type exercise bench that affords proper support for the user for prone as well as inclined bench pressing exercises.

Another object of the invention is to provide such a bench that is simple in construction and readily convertible from the horizontal to the inclined position.

Another object of the invention is to provide such a bench wherein the location of the user's shoulders remains constant, unaffected by the angular position of the seat cushions, whereby the user's "reach" to the rest position of the barbell or other load-bearing member remains constant.

Another object of the invention is to provide such a bench which easily can be converted into a more compact unit when not in use.

These and other objects of the invention are accomplished by providing an adjustable, floor-supported exercise bench for use in performing weightlifting or other resistance-type exercises having front and rear seat cushions arranged end-to-end, longitudinally of the bench, with front and rear subframes respectively supporting the front and rear seat cushions. Front and rear support means respectively pivotally support the front and rear subframes above the floor, and coupling means intermediate the front and rear support means pivotally interconnects the subframes; maintains the subframes in a locked position with the seat cushions substantially coplanar; and permits the subframes to pivot downwardly intermediate the front and rear support means to an unlocked position with the seat cushions diverging upwardly from their proximal ends.

This bench structure may be used in conjunction with any type of interactive means within reach of a user supported on the seat cushions, which provides interactive cooperation between the user and means providing a force that resists the user's exercise movements. For example, a pair of laterally spaced barbell support posts with cradles flanking the rear seat cushion (for resting a conventional barbell) could serve this interaction function, as could various types of linkages (pivoted, slidable or otherwise) that present to the user one or more handles to which a resistance force is applied, such as dead weight, springs, elastic members, hydraulics or the like.

BRIEF DESCRIPTION OF THE DRAWINGS

The novel features of the invention are set out with particularity in the appended claims, but the invention will be understood more fully and clearly from the following detailed description of a preferred embodiment of the invention as set forth in the accompanying drawings, in which:

DETAILED DESCRIPTION

The structural elements of the exercise bench of the invention largely are constructed of hollow, steel tubing. The various pieces are bolted or welded together, and paint or any other suitable protective coating is applied for a maintenance-free finish.

Figure 1:
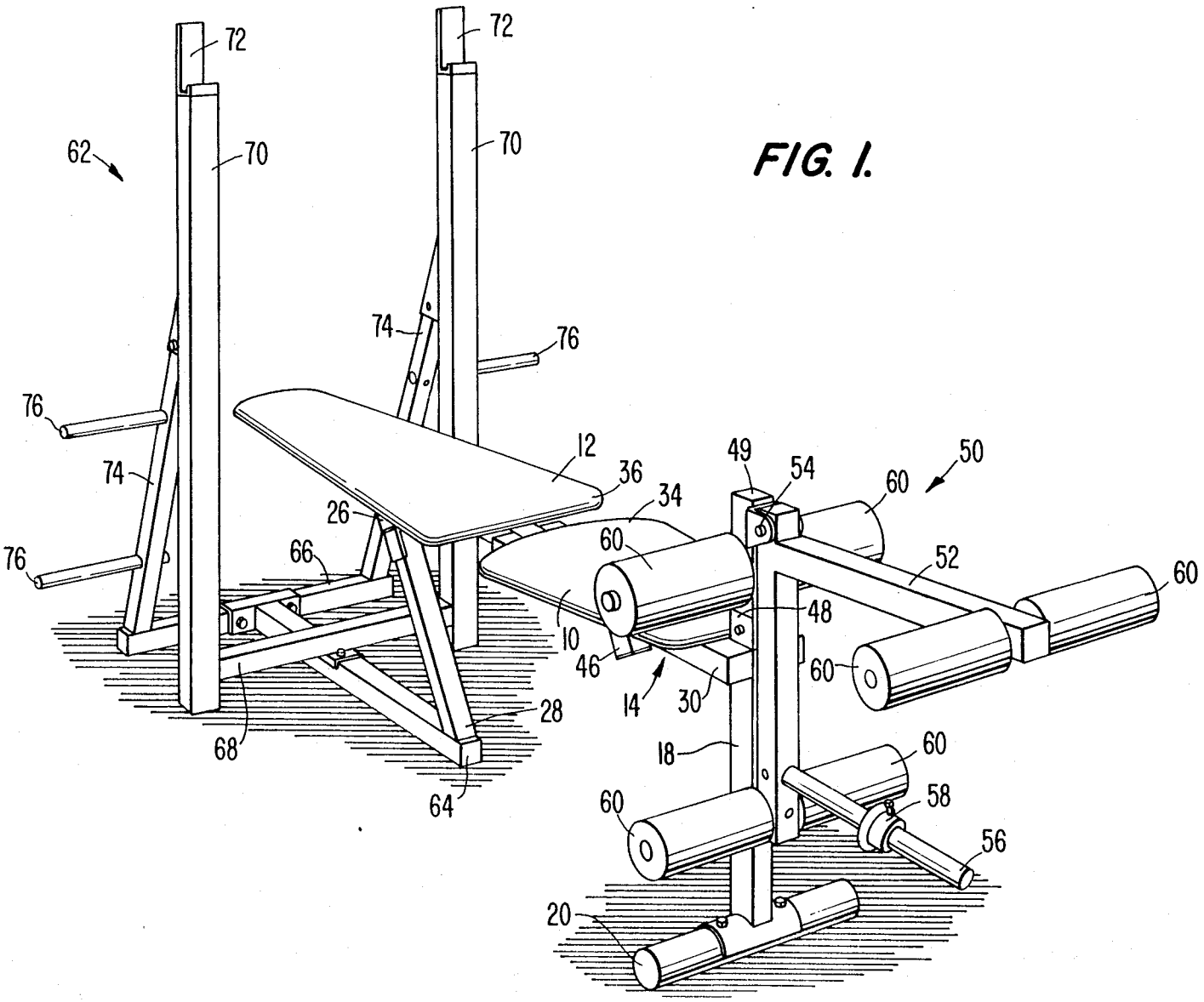
FIG. 1 is a front perspective view of the exercise bench of the invention with the seat cushions in their horizontal positions.
Figure 2:
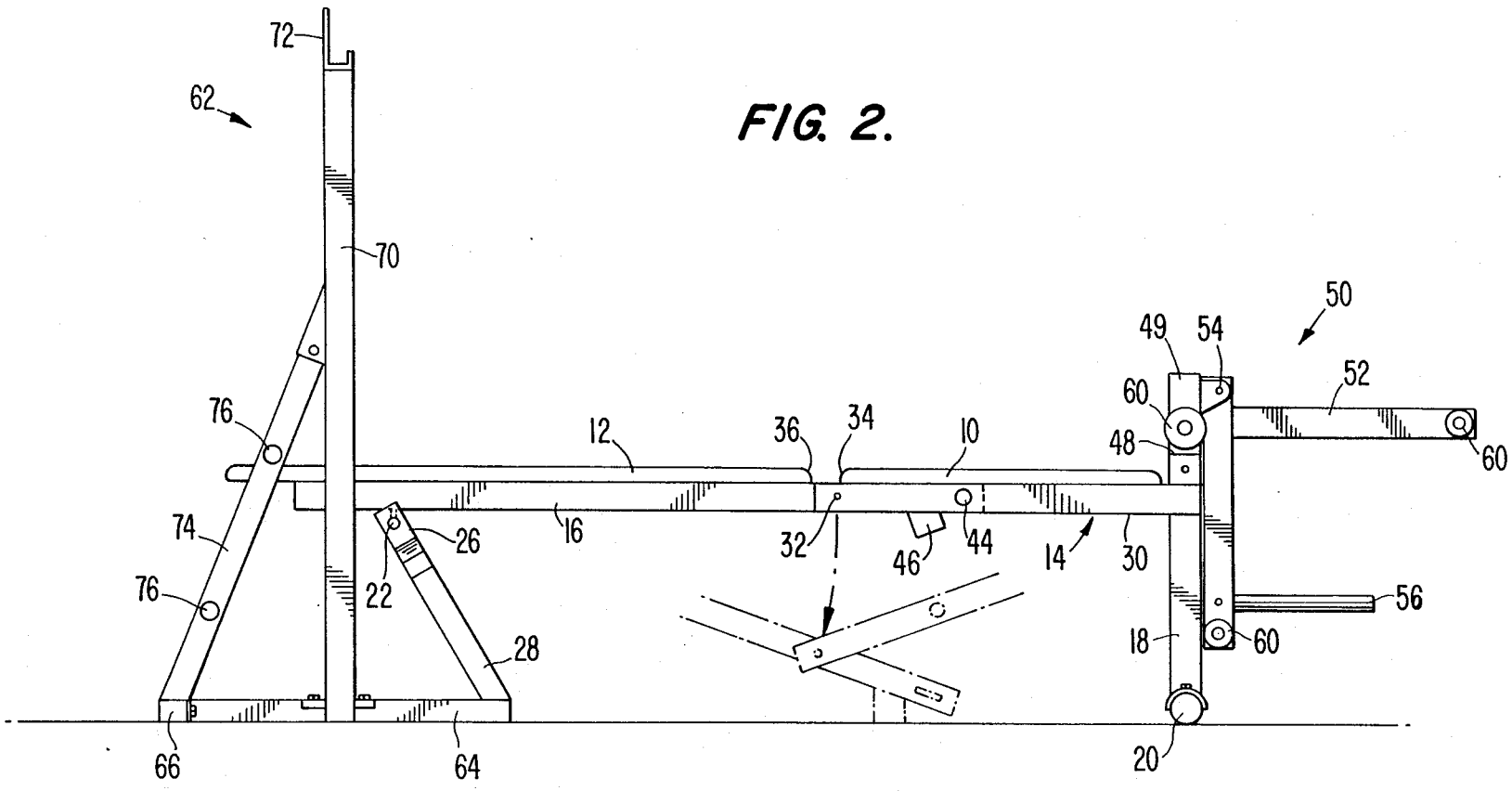
FIG. 2 is a side elevational view of the bench of FIG. 1, showing in phantom the inclined or unlocked positions of the subframes supporting the seat cushions.
Figure 3:
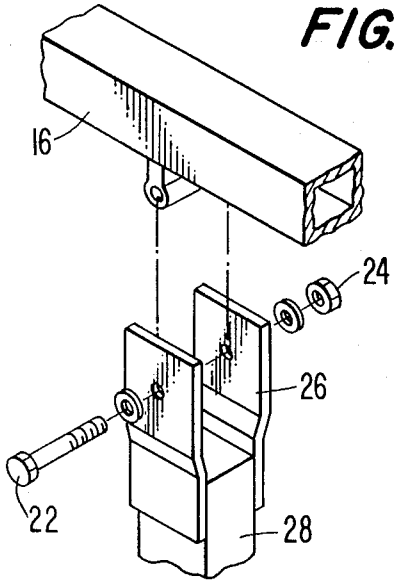
FIG. 3 is a perspective detail view of the support structure for the subframe of one of the seat cushions.

Referring to FIGS. 1 and 2, front and rear vinyl-covered seat cushions 10, 12 are arranged end-to-end, longitudinally of the bench. These cushions are supported respectively on front and rear subframes 14, 16, front subframe 14 being supported above the floor by a fixed-length, depending leg 18 welded perpendicular to front subframe 14 and having a floor-engaging foot 20 of circular cross section. Referring to FIG. 3, rear subframe 16 is pivotally supported by a bolt 22 (fastened by a nut 24) in clevis 26, which is welded to the upper end of an upwardly extending fixed support member 28. Support member 28 is secured to an exercise frame, details of which are described below.

Figure 4:
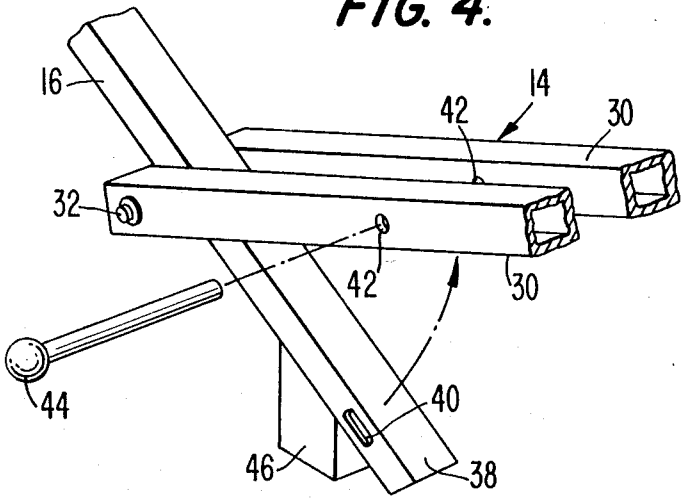
FIG. 4 is a perspective detail view of the pivoted interconnection between the subframes.

Rear subframe 16 comprises a single rail of square cross section that is bolted or otherwise suitably fastened to the plywood underside of rear seat cushion 12. Referring to FIG. 4, front subframe 14 consists of a pair of parallel spaced rails 30 of square cross-section that similarlarly are fastened to the plywood underside of front seat cushion 10. Rail 16 is received between and pivotally secured at 32 to rails 30 in the region of the proximal ends 34, 36 of seat cushions 10, 12. Adjacent the proximal end 38 of rail 16 is an aperture 40 which is aligned with mating holes 42 in rails 30 when all of the rails are parallel. These aligned holes 40, 42 are adapted to receive a lock pin 44 for maintaining the rails in parallel relationship and seat cushions 10, 12 substantially coplanar. A floor-engaging support foot 46 extends downwardly adjacent the proximal end 38 of rail 16 for supporting rail 14 (and, hence, rails 30) in inclined positions when lock pin 44 is removed. These inclined positions are illustrated in phantom in FIG. 2, and in FIG. 6.

Figure 6:
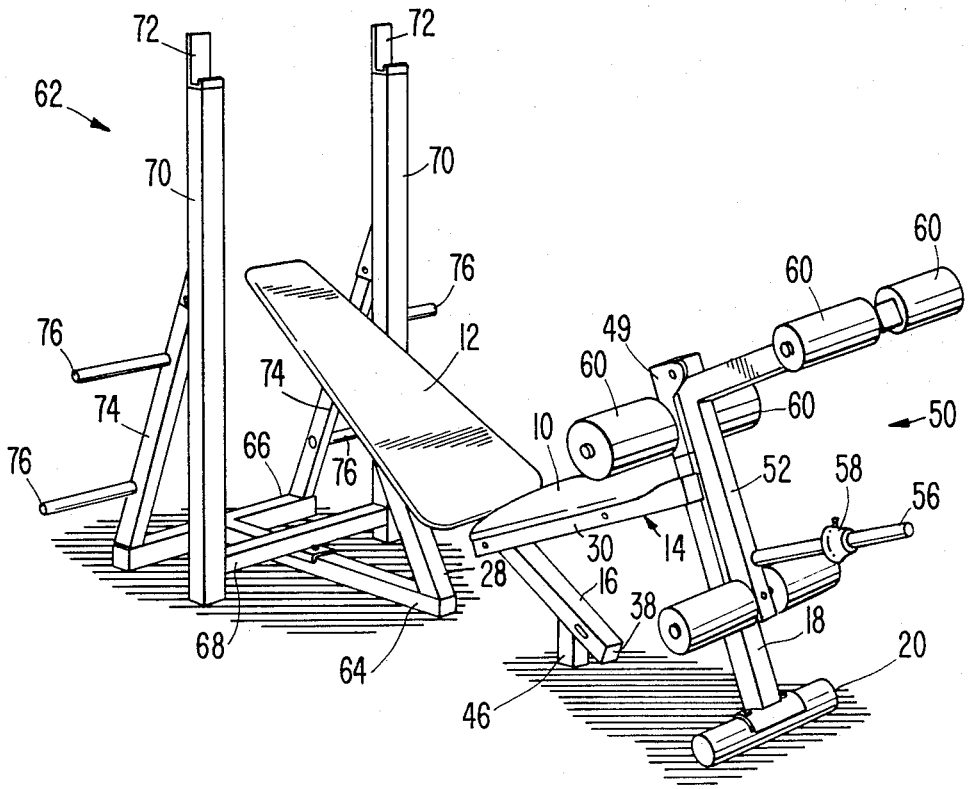
FIG. 6 is a front perspective view similar to FIG. 1 showing the bench with the seat cushions in their inclined positions.

The upper end of leg 18 is provided with a socket 48 which is adapted to receive the mounting post 49 of an exercise accessory, such as the leg exercise attachment 50 illustrated in FIGS. 1, 2 and 6. Leg exercise attachment 50 is fairly conventional and includes an L-shaped arm 52 pivoted to post 49 at 54 and having a projecting weight rod 56 with locking collar 58 for retaining a selected number of conventional barbell weights. Laterally projecting pairs of foam-cushioned leg pads 60 variously engage the knees and ankles of the user for performing leg extensions or leg curls, depending on whether the user is sitting on the bench or lying face down in a prone position.

As mentioned, fixed support member 28 is secured to an exercise frame 62 that is floor-supported and free-standing at the rear end of the bench. This frame comprises a longitudinal base member 64 bolted to cross members 66, 68; upright barbell support posts 70 flanking rear seat cushion 12 and bearing barbell support cradles 72 at their upper ends; and rear stabilizing struts 74 interconnecting barbell support posts 70 and cross member 66. Laterally projecting in cantilevered fashion from struts 74 are four bars 76 for storing unused barbell weights. The presence of weights on bars 76 adds to the overall stability of exercise frame 62.

Figure 7:
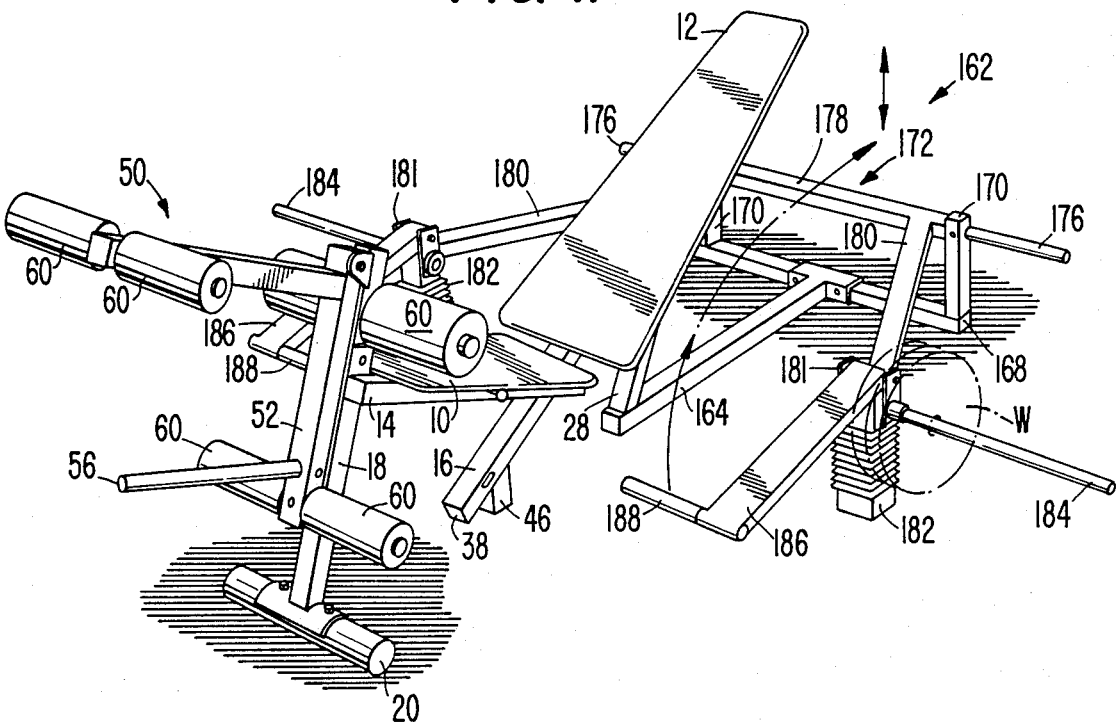
FIG. 7 is a perspective view of an alternate embodiment of the exercise bench of the invention.

In an alternate embodiment illustrated in FIG. 7 (wherein like numerals are used to denote like parts), the articulated bench of the invention may be associated with an exercise frame 162 that has pivoted weight-bearing members, instead of barbell rest cradles that are used with free weights. In this embodiment fixed support member 28 is secured to a longitudinal base member 164 that is bolted to cross member 168. Upright posts 170 are welded to the ends of cross member 168, and a weightlifting frame 172 is horizontally pivoted between posts 170. Weightlifting frame 172 comprises a horizontal bar 178 and two diverging arms 180, each arm 180 connected at its distal end to a clevis 181 having a floor-engaging pedestal 182 and a laterally outwardly projecting bar 184 for supporting a selected number of weights W. An arm 186 is pivoted in clevis 181 and has an inwardly projecting handle 188 at its distal end adapted to be grasped and lifted by a user lying on the bench, either with the seat cushions 10, 12 inclined (as illustrated in FIG. 7) or horizontal. Cantilevered bars 176 project laterally from posts 170 and are for storing unused weights, which add to the overall stability of the apparatus. The arrangement of pivoted weightlifting frame 172, with pedestals 182 and pivoted arms 186 having handles 188, makes the apparatus of FIG. 7 more convenient to use and renders it "self-spotting," thereby eliminating the need for an assistant to act as a spotter, which normally is required for safety when using free weights.

Figure 5:
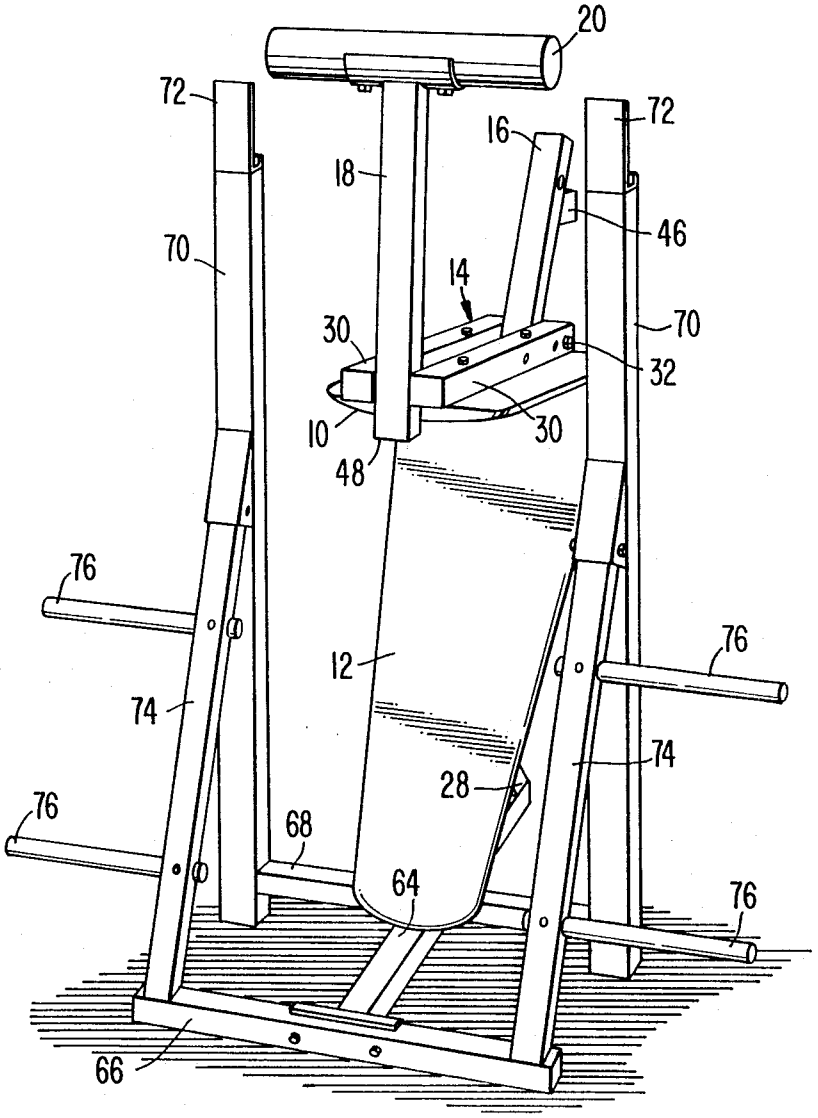
FIG. 5 is a rear perspective view showing the storage configuration of the bench elements, with the leg exercise accessory removed.

As illustrated in FIG. 5, the seat cushions 10, 12 and support leg 18 with foot 20 can be pivoted upwardly to a stable storage position in order to render the entire bench assembly more compact when not in use. (In FIG. 5 the leg exercise attachment 50 is not present). This is accomplished by removing lock pin 44 to allow the subframes to pivot relative to one another, and then raising front subframe 14 as far as it will go (counterclockwise as seen in FIG. 2), i.e., to a point where the seat cushions form a large acute angle between them. Rear subframe 16 then is raised and pivoted counterclockwise about its pivot 22 (along with front subframe 14) until the underside of the distal end of rear seat cushion 12 comes to rest against cross member 68.

Referring to FIGS. 2, 6 and 7, it can be seen that when lock pin 44 is removed so as to reconfigure the components to the inclined position, the proximal ends 34, 36 of cushions 10, 12 move downwardly while foot 20 at the lower end of leg 18 simply rotates about the floor, until intermediate support foot 46 itself comes to rest on the floor. The pivot point 22 for rear subframe 16 of course remains fixed. Pivot point 22 is located approximately beneath the position of the shoulders of a user lying either horizontal or inclined in preparation for performing prone or inclined bench presses. Accordingly, the position of the user's shoulders and, therefore, the position of his arms and hands relative to barbell cradles 72 remains constant, independent of the inclination of the cushions, making it comfortable and convenient for the user to perform either type of bench press with a barbell starting in and returning to cradles 72. In addition, with the seat cushions in their inclined positions, front seat cushion 10 provides proper support for the posterior of the user and comfortable positioning of the legs and feet relative to the floor for proper balance during exercise. Still further, the inclined position illustrated in FIG. 6 provides excellent back and shoulder support for a user who is performing leg extension exercises using the leg exercise attachment 50. Also, the fact that the center portion of the bench drops to achieve the inclined position keeps the center of gravity of the overall assembly low and adds to overall stability.

It will be appreciated by those skilled in the art that numerous modifications and changes may be made to the preferred embodiment without departing from the true scope of the invention, which is to be limited only by the appended claims. For example, as mentioned above, the articulated bench structure may be utilized with any type of exercise apparatus providing interactive means adapted to be engaged by and provide resistance to the user's movements. Depending leg 18, although illustrated as fixed in length and welded rigidly at a right angle to front subframe 14, could also be provided with adjustable features, such as length and angle adjustability. This would further enhance the angular variations that could be achieved so that other exercises could be performed. Depending leg 18 could even be made completely removable so that the distal end of front subframe 14 would rest on the floor, thereby facilitating the performance of sit-ups in a slanted position in conjunction with an ankle-engaging strap (not shown) near the distal end of rear subframe 16. Further, the single and double rail subframe arrangement illustrated in the figures could be reversed, with support foot 46 provided on a single rail beneath front subframe 14. Latching or locking devices other than lock pin 44 could also be used, as long as the rigidity of the components in their locked position is maintained and pivotal movement is not impaired. Still further, support foot 46 need not necessarily rest on the floor when the cushions are inclined if, for example, a portion of exercise frame 62 (such as member 64) extends further beneath the subframes. In that case support foot 46 would engage that extended portion of exercise frame 62. Numerous other variations will be apparent to those skilled in the art.

I claim:

1. An adjustable, floor-supported exercise bench for use in performing weight-lifting or other resistance-type exercises, and which supports a user in either a horizontal or an inclined position comprising:

front and rear seat cushions arranged end-to-end, longitudinally of the bench;

front and rear subframes respectively supporting said front and rear seat cushions;

front and rear support means respectively pivotally supporting said front and rear subframes above the floor, said front support means being rigidly secured to said front subframe adjacent its distal end to pivot about the floor as it supports the said distal end above the floor while maintaining said end at a substantially constant distance from the floor; and coupling means intermediate said front and rear support means for:

(a) pivotally interconnecting said subframes;

(b) maintaining said subframes in a locked position with said seat cushions substantially coplanar; and (c) permitting said subframes to pivot downwardly intermediate said front and rear support means from a locked horizontal position to an unlocked inclined position with said seat cushions diverging upwardly from their proximal ends.

2. An exercise bench according to claim 1 wherein said coupling means comprises a support foot near the proximal end of one of said subframes for supporting said subframes in their unlocked position.

3. An exercise bench according to claim 1 wherein said front subframe comprises a pair of parallel rails secured to the underside of said front seat cushion, said rear subframe comprises a single rail secured to the underside of said rear seat cushion, said single rail received between a portion of the length of said pair of rails with the proximal ends of said parallel rails pivotally connected to said single rail in the region of the proximal ends of said seat cushions and the proximal end of said single rail releasably pinned to said pair of rails beneath said front seat cushion.

4. An exercise bench according to claim 3 wherein said coupling means comprises a support foot near the proximal end of said single rail for engaging the floor and supporting said subframes in their unlocked positions.

5. An exercise bench according to claim 1 wherein said front support means comprises a depending leg at the distal end of said front subframe, the bottom of said depending leg pivoting about the floor as said subframes move between their locked and unlocked positions.

6. An exercise bench according to claim 5 wherein said rear support means comprises an upwardly extending fixed support member to which said rear subframe is hinged.

7. An exercise bench according to claim 6 wherein said front subframe comprises a pair of parallel rails secured to the underside of said front seat cushion, said rear subframe comprises a single rail secured to the underside of said rear seat cushion, said single rail received between a portion of the length of said pair of rails with the proximal ends of said parallel rails pivotally connected to said single rail in the region of the proximal ends of said seat cushions and the proximal end of said single rail releasably pinned to said pair of rails beneath said front seat cushion.

8. An exercise bench according to claim 7 wherein said coupling means comprises a support foot near the proximal end of said single rail for engaging the floor and supporting said subframes in their unlocked positions.

9. An exercise bench according to claim 5 wherein the top of said fixed leg is adapted to support a leg exercising attachment.

10. An exercise bench according to claim 1 wherein said rear support means comprises a weightlifting frame having:

(a) an upwardly extending fixed support member to which said rear subframe is hinged; and (b) interactive means within reach of a user supported on said seat cushions providing interactive cooperation between the user and resistance means.

11. An exercise bench according to claim 10 wherein said interactive means comprises a pair of upright barbell support posts flanking said rear seat cushion, each of said posts having a barbell rest cradle above said rear seat cushion.

12. An exercise bench according to claim 11 wherein said rear subframe is foldable to an upwardly extending storage position by upward pivotal movement about said fixed support member, said front subframe being stored between said barbell support posts by rearward pivotal movement thereof about said rear subframe.

13. An exercise bench according to claim 10 wherein said interactive means comprises a pivoted weight-lifting assembly adjacent said rear seat cushion, said weight-bearing assembly having handle means adapted to be grasped by a user lying on the bench.

14. An adjustable, floor-supported exercise bench for use in performing weight-lifting or other resistance-type exercises, and which supports a user in either a horizontal or an inclined position comprising:

a free-standing, floor-supported weightlifting frame having a pair of laterally spaced, upright barbell support posts and an upwardly extending fixed support member located medially of said barbell support posts, each of said posts having a barbell rest cradle at its upper end;

front and rear seat cushions arranged end-to-end, extending forwardly, longitudinally and medially of said barbell support posts with said rear seat cushion proximate said posts;

front and rear subframes respectively supporting said front and rear seat cushions, said rear subframe hinged to and supported by said fixed support member;

a depending leg supporting the front end of said front subframe, said depending leg having a fixed length and being disposed at a fixed angle to said front subframe as it contacts the floor and maintains the said distal end of the front subframe at a substantially constant distance above the floor; and coupling means intermediate said fixed support member and said depending leg for:

(a) pivotally interconnecting said subframes;

(b) maintaining said subframes in a locked position with said seat cushions substantially coplanar; and (c) permitting said subframes to pivot downwardly intermediate said fixed support member and said depending leg to a floor-supported unlocked position with said seat cushions diverging upwardly from their proximal ends, said rear subframe pivoting about said fixed support member and the bottom of said depending leg pivoting about the floor along with said front subframe.

15. An exercise bench according to claim 14 wherein said coupling means comprises a support foot near the proximal end of one of said subframes for engaging the floor and supporting said subframes in their unlocked position.

16. An exercise bench according to claim 15 wherein said front subframe comprises a pair of parallel rails secured to the underside of said front seat cushion, said rear subframe comprises a single rail secured to the underside of said rear seat cushion, said single rail received between a portion of the length of said pair of rails with the proximal ends of said parallel rails pivotally connected to said single rail in the region of the proximal ends of said seat cushions and the proximal end of said single rail releasably pinned to said pair of rails beneath said front seat cushion.

17. An exercise bench according to claim 16 wherein said coupling means comprises a support foot near the proximal end of said single rail for engaging the floor and supporting said subframes in their unlocked positions.

18. An exercise bench according to claim 17 wherein the top of said fixed leg is adapted to support a leg exercising attachment.

19. An exercise bench according to claim 18 wherein said rear subframe is foldable to an upwardly extending storage position by upward pivotal movement about said fixed support member, said front subframe being stored between said barbell support posts by rearward pivotal movement thereof about said rear subframe.

20. An exercise bench according to claim 19 wherein said weightlifting frame comprises laterally projecting cantilevered bars for storing unused barbell weights.

* * * * *